US009371638B2

(12) United States Patent
Wong

(10) Patent No.: US 9,371,638 B2
(45) Date of Patent: Jun. 21, 2016

(54) TEAR DROP TOILET PLUNGER

(71) Applicant: Silas Wong, Anchorage, AK (US)

(72) Inventor: Silas Wong, Anchorage, AK (US)

( * ) Notice: Subject to any disclaimer, the term of this patent is extended or adjusted under 35 U.S.C. 154(b) by 173 days.

(21) Appl. No.: 14/173,450

(22) Filed: Feb. 5, 2014

(65) Prior Publication Data

US 2015/0218787 A1 Aug. 6, 2015

(51) Int. Cl.
*E03D 11/00* (2006.01)
*E03C 1/308* (2006.01)

(52) U.S. Cl.
CPC ..... *E03C 1/308* (2013.01)

(58) Field of Classification Search
USPC ..... 4/255.11, 255.01, 255.05, 255.12, 4/255.04, 255.06, 255.07, 255.09, 4/255.03, 255.08
See application file for complete search history.

(56) References Cited

U.S. PATENT DOCUMENTS

| | | | | |
|---|---|---|---|---|
| 915,687 A | | 3/1909 | Lowe | |
| D46,997 S | * | 2/1915 | Howell | 4/255.11 |
| D84,483 S | * | 6/1931 | Kelley | 68/215 |
| 2,231,046 A | * | 2/1941 | Woodson | D06F 5/02 68/215 |
| 6,216,283 B1 | | 4/2001 | Tash | |
| 6,859,949 B1 | | 3/2005 | Gavin | |
| D680,282 S | | 4/2013 | Daciw | |
| 2006/0213791 A1 | * | 9/2006 | Holden | A47K 17/00 206/349 |
| 2008/0134421 A1 | * | 6/2008 | Sheffield | E03D 9/00 4/255.11 |
| 2011/0219526 A1 | * | 9/2011 | Keegan | E03C 1/308 4/255.12 |
| 2012/0233757 A1 | * | 9/2012 | Slot | E03C 1/308 4/255.05 |

FOREIGN PATENT DOCUMENTS

| | | |
|---|---|---|
| EP | 1108095 | 1/2003 |
| JP | 2009100879 A | 5/2009 |

* cited by examiner

*Primary Examiner* — J. Casimer Jacyna
*Assistant Examiner* — Benjamin R Shaw

(57) ABSTRACT

A toilet plunger device facilitates sealed engagement of a plunger around a trap opening in a toilet bowl. The device includes a shaft having a top end and a bottom end. A cup is coupled to the bottom end of the shaft. A bottom edge of the cup has an arcuate portion and a tip positioned opposite the arcuate portion wherein the bottom edge is teardrop shaped and configured for abutting a toilet bowl surrounding a trap opening in the toilet bowl forming a seal between the cup and the toilet bowl. Thus, movement of the cup relative to the toilet bowl produces pressure through the trap opening.

8 Claims, 3 Drawing Sheets

TEAR DROP TOILET PLUNGER

BACKGROUND OF THE DISCLOSURE

Field of the Disclosure

The disclosure relates to plunger devices and more particularly pertains to a new plunger device for facilitating sealed engagement of a plunger around a trap opening in a toilet bowl.

SUMMARY OF THE DISCLOSURE

An embodiment of the disclosure meets the needs presented above by generally comprising a shaft having a top end and a bottom end. A cup is coupled to the bottom end of the shaft. A bottom edge of the cup has an arcuate portion and a tip positioned opposite the arcuate portion wherein the bottom edge is teardrop shaped and configured for abutting a toilet bowl surrounding a trap opening in the toilet bowl forming a seal between the cup and the toilet bowl. Thus, movement of the cup relative to the toilet bowl produces pressure through the trap opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
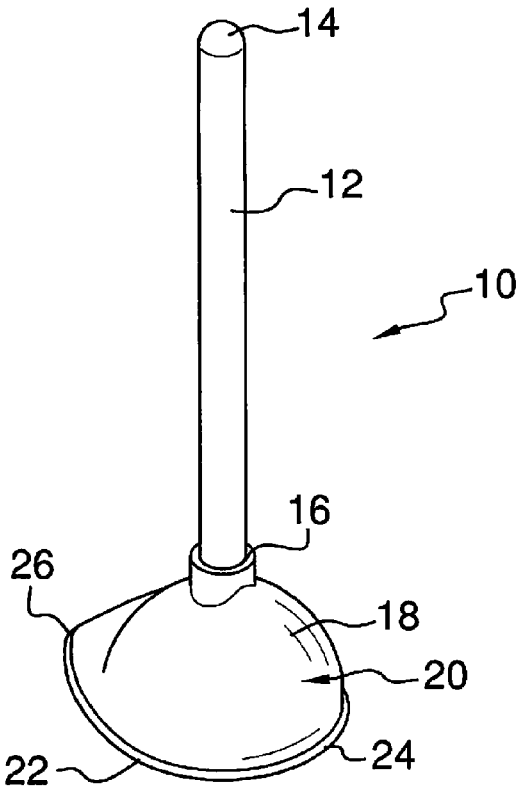
FIG. 1 is a top front side perspective view of a toilet plunger device according to an embodiment of the disclosure.
Figure 2:
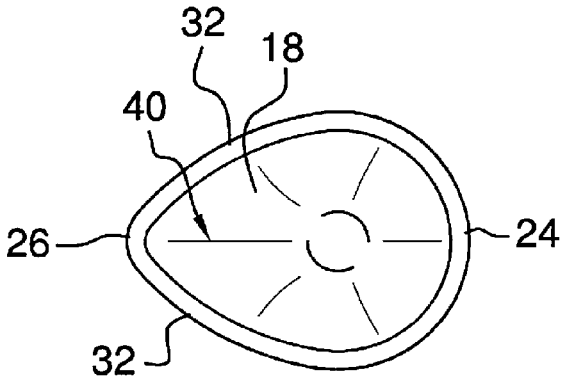
FIG. 2 is a bottom view of an embodiment of the disclosure.
Figure 3:
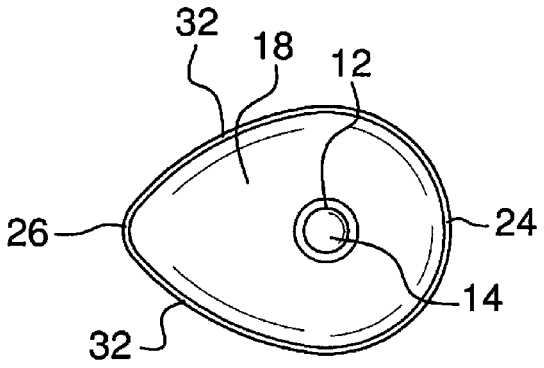
FIG. 3 is a top view of an embodiment of the disclosure.
Figure 4:
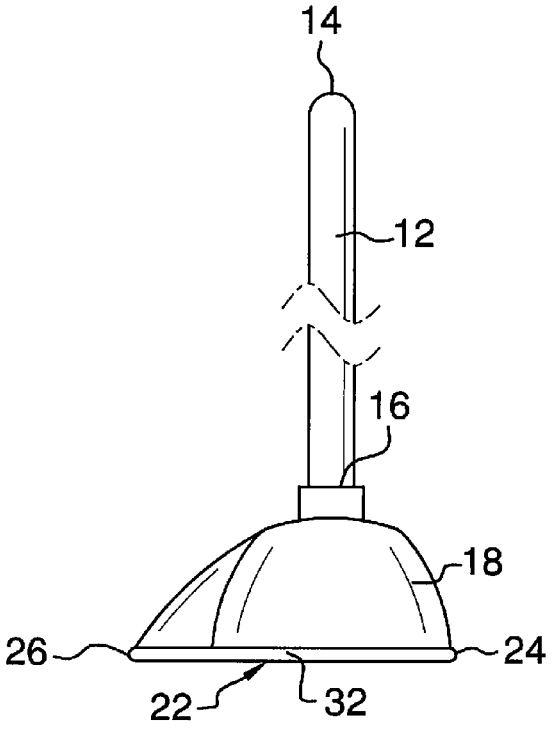
FIG. 4 is a side view of an embodiment of the disclosure.
Figure 5:
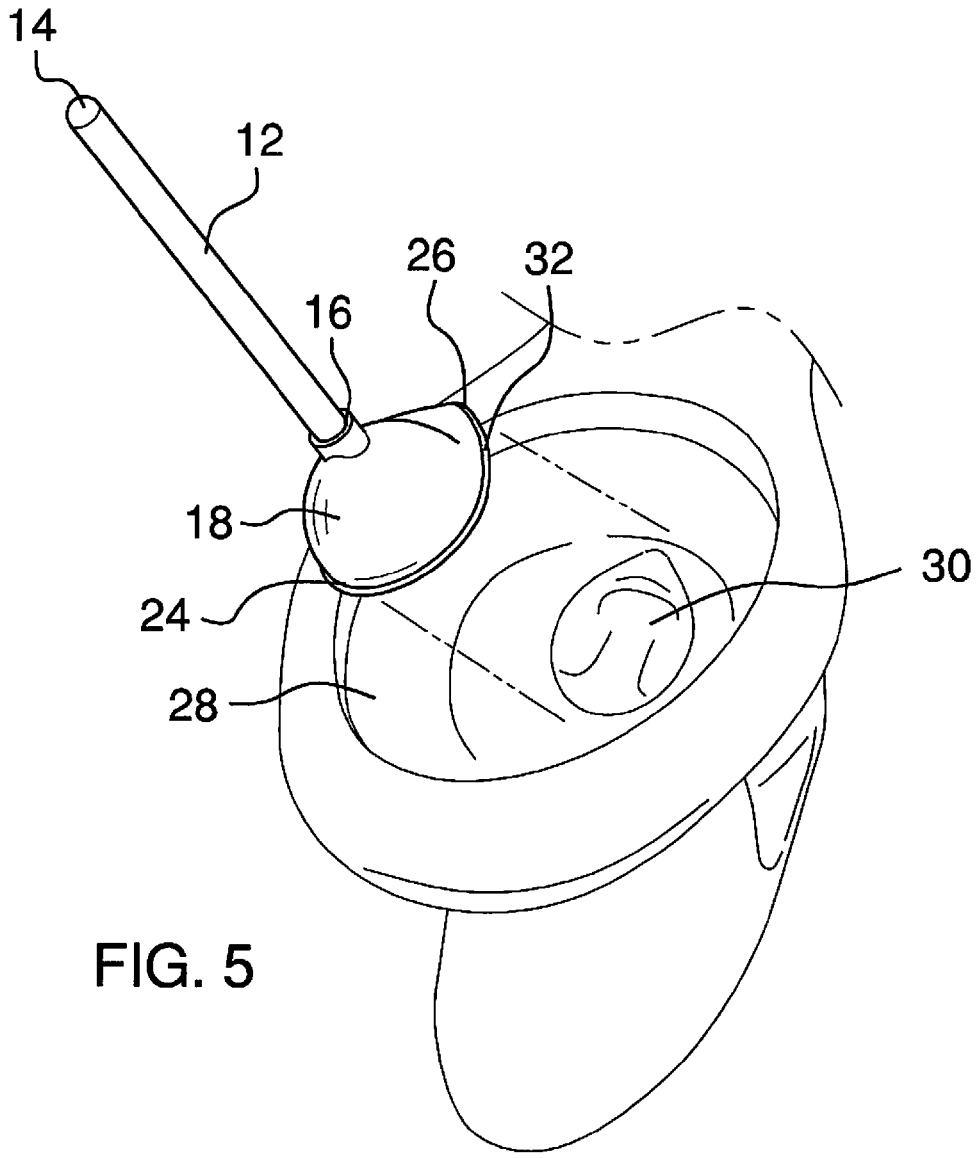
FIG. 5 is a partially exploded top front side perspective view of an embodiment of the disclosure in use.

With reference now to the drawings, and in particular to FIGS. 1 through 5 thereof, a new plunger device embodying the principles and concepts of an embodiment of the disclosure and generally designated by the reference numeral 10 will be described.

As best illustrated in FIGS. 1 through 5, the toilet plunger device 10 generally comprises an elongated shaft 12 constructed of wood, plastic or the like. The shaft 12 has a top end 14 and a bottom end 16. A cup 18 is coupled to the bottom end 16 of the shaft 12. The cup 18 is resiliently flexible and is constructed of a resilient material 20 such as rubber. A bottom edge 22 of the cup 18 has an arcuate portion 24 and a tip 26 positioned opposite the arcuate portion 24. Thus, the bottom edge 22 is substantially teardrop shaped such that the bottom edge 22 of the cup 18 is configured for abutting a toilet bowl 28 surrounding a trap opening 30 in the toilet bowl 28 forming a seal between the cup 18 and the toilet bowl 32. In conventional fashion, movement of the cup 18 relative to the toilet bowl 28 by moving the shaft 12 produces pressure through the trap opening 30. The arcuate section 24 of the bottom edge 22 is semi-circular and the tip 26 is rounded. The bottom edge 22 of the cup 18 has a pair of extension sections 32 extending between the arcuate section 24 and the tip 26 wherein the bottom edge 22 tapers extending away from the arcuate section 24 towards the tip 26. Each of the extension sections 32 is convex relative to an interior 40 of the cup 18 such that each extension section 32 bows outwardly between the arcuate section 24 and the tip 26.

In use, the device 10 is manipulated in the same manner as a conventional toilet plunger to remove or break up clogs. The teardrop shape of the bottom edge 22 facilitates sealed engagement of the cup 18 around the trap opening 30 when the trap opening 30 or general shape of the toilet bowl 28 does not provide for a surface easily engaged by a circular shape.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toilet plunger device comprising:

a shaft having a top end and a bottom end;

a cup coupled to said bottom end of said shaft; and a bottom edge of said cup having an arcuate portion and a tip positioned opposite said arcuate portion, said arcuate portion being semi-circular wherein said bottom edge is teardrop shaped such that said bottom edge of said cup is configured for abutting a toilet bowl surrounding a trap opening in the toilet bowl forming a seal between said cup and the toilet bowl wherein movement of said cup relative to the toilet bowl produces pressure through the trap opening.

2. The device of claim 1, further comprising said cup being constructed of a resilient material.

3. The device of claim 2, further comprising said resilient material being rubber.

4. The device of claim 1, further comprising said cup being resiliently flexible.

5. The device of claim 1, further comprising said tip being rounded.

6. The device of claim 1, further comprising said bottom edge of said cup having a pair of extension sections extending between said arcuate section and said tip, said extension sections extending away from said arcuate section and towards each other such that a portion of said bottom edge tapers extending away from said arcuate section towards said tip.

7. The device of claim 6, further comprising each of said extension sections bowing outwardly relative to an interior of said cup between said arcuate section and said tip.

8. A toilet plunger device comprising:

a shaft having a top end and a bottom end;

a cup coupled to said bottom end of said shaft, said cup being resiliently flexible, said cup being constructed of a resilient material, said resilient material being rubber; and a bottom edge of said cup having an arcuate portion and a tip positioned opposite said arcuate portion wherein said bottom edge is teardrop shaped such that said bottom edge of said cup is configured for abutting a toilet bowl surrounding a trap opening in the toilet bowl forming a seal between said cup and the toilet bowl wherein movement of said cup relative to the toilet bowl produces pressure through the trap opening, said arcuate section of said bottom edge being semi-circular, said tip being rounded, said bottom edge of said cup having a pair of extension sections extending between said arcuate section and said tip, said extension sections extending away from said arcuate section and towards each other such that a portion of said bottom edge tapers extending away from said arcuate section towards said tip, each of said extension sections bowing outwardly relative to an interior of said cup between said arcuate section and said tip.

* * * * *